US010927493B2

(12) United States Patent
Sasaki et al.

(10) Patent No.: US 10,927,493 B2
(45) Date of Patent: Feb. 23, 2021

(54) DRYER AND ABSOLUTE HUMIDITY DIFFERENCE SENSOR

(71) Applicant: SHIBAURA ELECTRONICS CO., LTD., Saitama (JP)

(72) Inventors: Hiroyuki Sasaki, Senboku (JP); Tatsuya Konno, Saitama (JP); Junya Togashi, Senboku (JP); Masahiro Haga, Senboku (JP)

(73) Assignee: SHIBAURA ELECTRONICS CO., LTD., Saitama (JP)

( * ) Notice: Subject to any disclaimer, the term of this patent is extended or adjusted under 35 U.S.C. 154(b) by 310 days.

(21) Appl. No.: 16/068,841

(22) PCT Filed: Apr. 7, 2016

(86) PCT No.: PCT/JP2016/001942
§ 371 (c)(1),
(2) Date: Jul. 9, 2018

(87) PCT Pub. No.: WO2017/175257
PCT Pub. Date: Oct. 12, 2017

(65) Prior Publication Data

US 2019/0017218 A1 Jan. 17, 2019

(51) Int. Cl.
*D06F 58/30* (2020.01)
*D06F 58/38* (2020.01)
*D06F 103/08* (2020.01)

(52) U.S. Cl.
CPC ..... *D06F 58/30* (2020.02); *D06F 58/38* (2020.02); *D06F 2103/08* (2020.02)

(58) Field of Classification Search
CPC ..... D06F 58/28; D06F 58/30; D06F 58/38; D06F 2103/08; D06F 2058/2829; H05B 6/6458
(Continued)

(56) References Cited

U.S. PATENT DOCUMENTS 4,485,566 A * 12/1984 Vivares ..... D06F 58/30 34/547
4,587,393 A * 5/1986 Ueda ..... H05B 6/6411 219/707
(Continued)

FOREIGN PATENT DOCUMENTS

JP H1-259406 A 10/1989
JP H02-257998 A 10/1990
(Continued)

OTHER PUBLICATIONS

International Search Report for International Application No. PCT/JP2016/001942, dated Aug. 2, 2016.
(Continued)

*Primary Examiner* — Edelmira Bosques
*Assistant Examiner* — Bao D Nguyen
(74) *Attorney, Agent, or Firm* — Pearne & Gordon LLP

(57) ABSTRACT

In a dryer, humidity of supply air in a supply path of a heat pump dryer unit is directly detected by a first humidity detection sensor, and humidity of exhaust air in a discharge path is directly detected by a second humidity detection sensor. The first and second humidity detection sensors are collectively installed at one place, and a first conduit or a second conduit that guides the supply air or the exhaust air to a position of the corresponding sensor is provided. The sensors may be collectively disposed at one place in the supply path or the discharge path. This facilitates mounting of the sensor and saves a mounting space. Because environment temperatures of the two humidity sensors can be regarded as equal to each other when using relative humidity sensors, temperature detection for conversion into absolute humidity can be performed at one place.

20 Claims, 7 Drawing Sheets

(58) Field of Classification Search
USPC ..... 34/524
See application file for complete search history.

(56) References Cited

U.S. PATENT DOCUMENTS

| | | | | | |
|---|---|---|---|---|---|
| 4,649,654 | A * | 3/1987 | Hikino | D06F 58/30 | 34/493 |
| 4,733,479 | A * | 3/1988 | Kaji | D06F 58/30 | 34/446 |
| 4,797,656 | A * | 1/1989 | Keppler | G08B 1/08 | 340/539.26 |
| 4,911,357 | A * | 3/1990 | Kitamura | G01N 25/18 | 236/44 E |
| 5,050,313 | A * | 9/1991 | Wakaeya | F26B 21/06 | 34/454 |
| 5,105,555 | A * | 4/1992 | Nakagomi | B29B 13/065 | 34/259 |
| 5,161,314 | A * | 11/1992 | Souza | D06F 58/30 | 34/493 |
| 5,649,372 | A * | 7/1997 | Souza | D06F 58/30 | 34/491 |
| 2002/0136664 | A1* | 9/2002 | Lee | G01N 27/121 | 422/98 |
| 2002/0149486 | A1* | 10/2002 | Lee | H05B 6/6458 | 340/602 |
| 2006/0162182 | A1* | 7/2006 | Wong | D06F 58/30 | 34/486 |
| 2007/0039200 | A1* | 2/2007 | Hwang | D06F 58/30 | 34/474 |
| 2007/0251118 | A1* | 11/2007 | Doh | D06F 58/30 | 34/528 |
| 2008/0104860 | A1* | 5/2008 | Muenzner | D06F 58/30 | 34/427 |
| 2008/0175759 | A1* | 7/2008 | Oishi | G01N 33/005 | 422/98 |
| 2011/0198405 | A1* | 8/2011 | Krausch | D06F 58/206 | 236/44 C |
| 2012/0216982 | A1* | 8/2012 | Lee | F24F 12/006 | 165/11.1 |
| 2013/0008232 | A1* | 1/2013 | Bergsten | F24F 11/30 | 73/29.01 |
| 2014/0144036 | A1* | 5/2014 | Caldeira | D06F 58/02 | 34/86 |
| 2014/0366397 | A1* | 12/2014 | Wakizaka | D06F 58/30 | 34/524 |
| 2015/0368854 | A1* | 12/2015 | Anderson | D06F 58/30 | 34/491 |
| 2016/0061461 | A1* | 3/2016 | Ito | F25D 21/12 | 62/271 |
| 2016/0084511 | A1* | 3/2016 | Hamada | F24F 3/06 | 62/172 |
| 2016/0160427 | A1* | 6/2016 | Lee | D06F 58/30 | 34/443 |
| 2016/0160430 | A1* | 6/2016 | Lee | D06F 58/30 | 34/474 |
| 2016/0160431 | A1* | 6/2016 | Lee | D06F 58/30 | 34/499 |
| 2017/0159964 | A1* | 6/2017 | Arai | F24F 11/83 | |
| 2018/0306462 | A1* | 10/2018 | Ito | F24F 13/22 | |
| 2020/0182500 | A1* | 6/2020 | Ha | F24F 3/14 | |

FOREIGN PATENT DOCUMENTS

| | | | |
|---|---|---|---|
| JP | H08-203665 | A | 8/1996 |
| JP | 2006-071222 | A | 3/2006 |
| JP | 2011-120778 | A | 6/2011 |
| JP | 2014-012074 | A | 1/2014 |
| JP | 2014-045954 | A | 3/2014 |
| KR | 2002-0076590 | A | 10/2002 |

OTHER PUBLICATIONS

English translation of Japanese Office Action for Application No. 2017-559481, dated Feb. 23, 2018.

Extended European Search Report for Application No. 16897816.1, dated Nov. 6, 2018.

* cited by examiner

DRYER AND ABSOLUTE HUMIDITY DIFFERENCE SENSOR

CROSS-REFERENCE TO RELATED APPLICATIONS

This is a National Stage application of PCT international application PCT/JP2016/001942, filed on Apr. 7, 2016, which is incorporated herein by reference in its entirety.

TECHNICAL FIELD

The present invention relates to a dryer, including a humidity sensor, of a drying object, and to a humidity sensor suitable for detecting humidity inside the dryer.

BACKGROUND ART

In recent years, a washer/dryer that includes both functions of washing and drying is mainly produced as a washing machine. As drying systems of the washer/dryer, a heater system and a heat pump system are well-known.

In the heater system, air heated by a heater (heating section) is fed to a drying drum through a supply path, and the air absorbs moisture contained in a drying object. The air discharged from the drying drum is fed to a cooling pipe section (cooling section) through a discharge path. As a result, dew condensation occurs and the moisture is removed from the air.

On the other hand, the heat pump system includes a heat circulation mechanism that includes a compressor compressing a refrigerant, a heating-side heat exchanger, an expansion valve, and a cooling-side heat exchanger. When the compressor compresses the refrigerant, temperature of the heating-side heat exchanger (heating section) is increased by compression heat. The air to be fed into the drying drum is heated at this section, and the heated air is fed to the drying drum through the supply path. Subsequently, when the refrigerant is released by the expansion valve, temperature of the refrigerant is decreased, and the refrigerant accordingly cools the cooling-side heat exchanger (cooling section). The air discharged from the drying drum is fed to the cooling section through the discharge path. As a result, dew condensation occurs and the moisture is removed from the air.

When the two drying systems are compared, both drying systems include the heating section generating heated air, the supply path supplying the heated air to the drying drum, the discharge path discharging the moist air from the drying drum, and the cooling section removing moisture from the exhaust air, in common with each other.

Examples of the washer/dryer include a washer/dryer disclosed in Patent Literature 1. The dryer does not detect relative humidity with use of a humidity sensor, but determines the relative humidity based on a temperature value detected by a temperature sensor. In other words, a correspondence table of the temperature and the relative humidity is previously stored by a nonvolatile memory, and a humidity value is taken from the table. Detection accuracy of such indirect detection is inferior to accuracy of direct detection using the humidity sensor. Therefore, there remain problems, for example, the drying object is excessively dried and the cloth of the drying object is accordingly damaged due to erroneous detection of the humidity as a value larger than a value of the actual humidity, or the drying is terminated in a half-dried state due to erroneous detection of the humidity as a value lower than the value of the actual humidity.

In addition, the supply path and the discharge path of the washer/dryer include little extra space for mounting of the sensor detecting the humidity difference and include a complicated structure. Therefore, it is not easy to mount the sensor. Improvement with respect to this problem is also desired.

CITATION LIST

Patent Literature

Patent Literature 1: JP 2014-12074 A

SUMMARY OF INVENTION

Technical Problem

In consideration of the above-described problems, an object of the present invention is to provide a dryer that directly detects humidity inside the dryer with use of a humidity sensor to prevent overdrying and insufficient drying, and facilitates mounting of the humidity sensor.

Solution to Problem

A dryer according to the present invention that solves the above-described problems, includes a drying drum configured to house a drying object, a supply path configured to feed supply air that is heated air, to an inside of the drying drum, a discharge path configured to take in exhaust air that is air discharged from the inside of the drying drum, and a humidity difference sensor that includes a first humidity detection sensor configured to detect first humidity as humidity of the supply air, and a second humidity detection sensor configured to detect second humidity as humidity of the exhaust air. The first humidity detection sensor and the second humidity detection sensor of the humidity difference sensor are collectively provided at one place. Since the two sensors are collectively installed at one place, labor for installation is reduced and a space is saved. Further, the both sensors are placed in the substantially same temperature environment. Therefore, if the humidity detection sensors are relative humidity sensors and conversion into absolute humidity is performed, only one temperature detection sensor is enough advantageously.

The first humidity detection sensor included in the dryer according to the present invention preferably includes a first detection chamber, a first heat-sensitive element housed in the first detection chamber, and a first ventilation window through which the supply air is supplied to the first detection chamber. The second humidity detection sensor preferably includes a second detection chamber adjacent to the first detection chamber, a second heat-sensitive element housed in the second detection chamber, and a second ventilation window through which the exhaust air is supplied to the second detection chamber.

The dryer according to the present invention at least includes the following first and second modes for installation of the humidity difference sensor.

Note that, it is assumed that each of the first and second modes includes a heating source configured to heat the exhaust air supplied from the discharge path, to generate the supply air, and a heating unit configured to feed the generated supply air to the supply path.

The humidity difference sensor in the first mode is disposed in a region where the supply air passes, inside the heating unit. Further, the first humidity detection sensor detects the first humidity when the supply air is supplied to the first detection chamber through the first ventilation window, and the second humidity detection sensor detects the second humidity when the exhaust gas obtained upstream of the heating source is guided through a second conduit and is supplied to the second detection chamber through the second ventilation window.

The exhaust air is guided to a region of air feeding side through the second conduit, which makes it possible to detect the humidity of the exhaust air and the humidity of the supply air in a collective region on the air feeding side.

Next, the humidity difference sensor in the second mode is disposed in a region where the exhaust air passes, inside the heating unit. Further, the first humidity detection sensor detects the first humidity when the supply air obtained downstream of the heating source is guided through a first conduit and is supplied to the first detection chamber through the first ventilation window, and the second humidity detection sensor detects the second humidity when the exhaust air is supplied to the second detection chamber through the second ventilation window.

The supply air is guided to a region of air discharging side through the first conduit, which makes it possible to detect the humidity of the exhaust air and the humidity of the supply air in a collective region on the air discharging side.

In the dryer according to the present invention, the first humidity detection sensor and the second humidity detection sensor preferably configure an absolute humidity difference sensor that detects absolute humidity difference. This makes it possible to reduce labor for conversion into absolute humidity, as with a case of using a relative humidity sensor.

In the dryer according to the present invention, a method of determining a degree of drying includes the following first and second modes.

In the first mode, a determination section determines a degree of drying based on comparison between the absolute humidity difference detected by the absolute humidity difference sensor and a predetermined value.

Further, in the second mode, the determination section determines a degree of drying based on comparison between a time change rate of the absolute humidity difference detected by the absolute humidity difference sensor and a predetermined value.

In any mode, the determination section can determine operation stop or operation continuation of the dryer based on a result of the determination.

Even when the dryer according to the present invention adopts any heating system out of a heat pump system and a heater system, the dryer makes it possible to achieve similar effects.

The present invention provides an absolute humidity difference sensor suitable for the above-described dryer.

The absolute humidity difference sensor according to the present invention detects absolute humidity difference between first detection air and second detection air existing at a position different from a position of the first detection air. The absolute humidity difference sensor includes a first humidity detection sensor, a second humidity detection sensor, and a bridge circuit.

The first humidity detection sensor includes a first detection chamber, a second detection chamber adjacent to the first detection chamber, the first detection chamber, a first heat-sensitive element housed in the first detection chamber, and a first ventilation window through which the first detection air is supplied to the first detection chamber. The second humidity detection sensor includes a second detection chamber adjacent to the first detection chamber, a second heat-sensitive element housed in the second detection chamber, and a second ventilation window through which the second detection air is supplied to the second detection chamber. The bridge circuit includes the first heat-sensitive element and the second heat-sensitive element in adjacent sides.

Further, the absolute humidity difference sensor according to the present invention detects absolute humidity difference between the first detection air and the second detection air, based on an unbalanced voltage of the bridge circuit when the first detection air is brought into contact with the first heat-sensitive element and the second detection air is brought into contact with the second heat-sensitive element.

In the absolute humidity difference sensor according to the present invention, each of the first heat-sensitive element and the second heat-sensitive element also can detect surrounding temperature. As described above, the absolute humidity difference sensor according to the present invention also performs a function as a temperature sensor.

In the absolute humidity difference sensor according to the present invention, the first humidity detection sensor may include a first reference element configured to generate a reference signal of absolute humidity, and the second humidity detection sensor may include a second reference element configured to generate a reference signal of absolute humidity. As described above, the absolute humidity difference sensor may be configured of the four heat-sensitive elements.

In addition, the absolute humidity difference sensor according to the present invention preferably includes one or both of a first conduit configured to guide the first detection air to the first ventilation window and a second conduit configured to guide the second detection air to the second ventilation window. This makes it possible to detect absolute humidity difference between the detection air at different positions.

Advantageous Effects of Invention

According to the dryer of the present invention, the humidity difference between the supply air and the exhaust air is directly detected by the humidity difference sensor that includes the first humidity detection sensor and the second humidity detection sensor. Therefore, it is possible to accurately determine the humidity as compared with a case where the drying is determined by the humidity based on the detected temperature. Accordingly, the dryer of the present invention makes it possible to terminate the drying in an appropriate drying state.

Further, according to the dryer of the present invention, the first humidity detection sensor and the second humidity detection sensor are collectively provided at one place. This makes it easy to mount the sensors and to save the mounting space, as compared with a case where the two humidity detection sensors are mounted at different separated places.

Moreover, according to the dryer of the present invention, the first humidity detection sensor and the second humidity detection sensor are collectively provided at one place. Therefore, the surrounding temperature of the two humidity detection sensors are regarded as equal to each other. Accordingly, in a case where each of the two humidity detection sensors is a relative humidity sensor, the detected relative humidity can be converted into the absolute humidity only by one temperature sensor.

DESCRIPTION OF EMBODIMENTS

Some embodiments of the present invention are described below with reference to accompanying drawings.

First Embodiment

Figure 1:
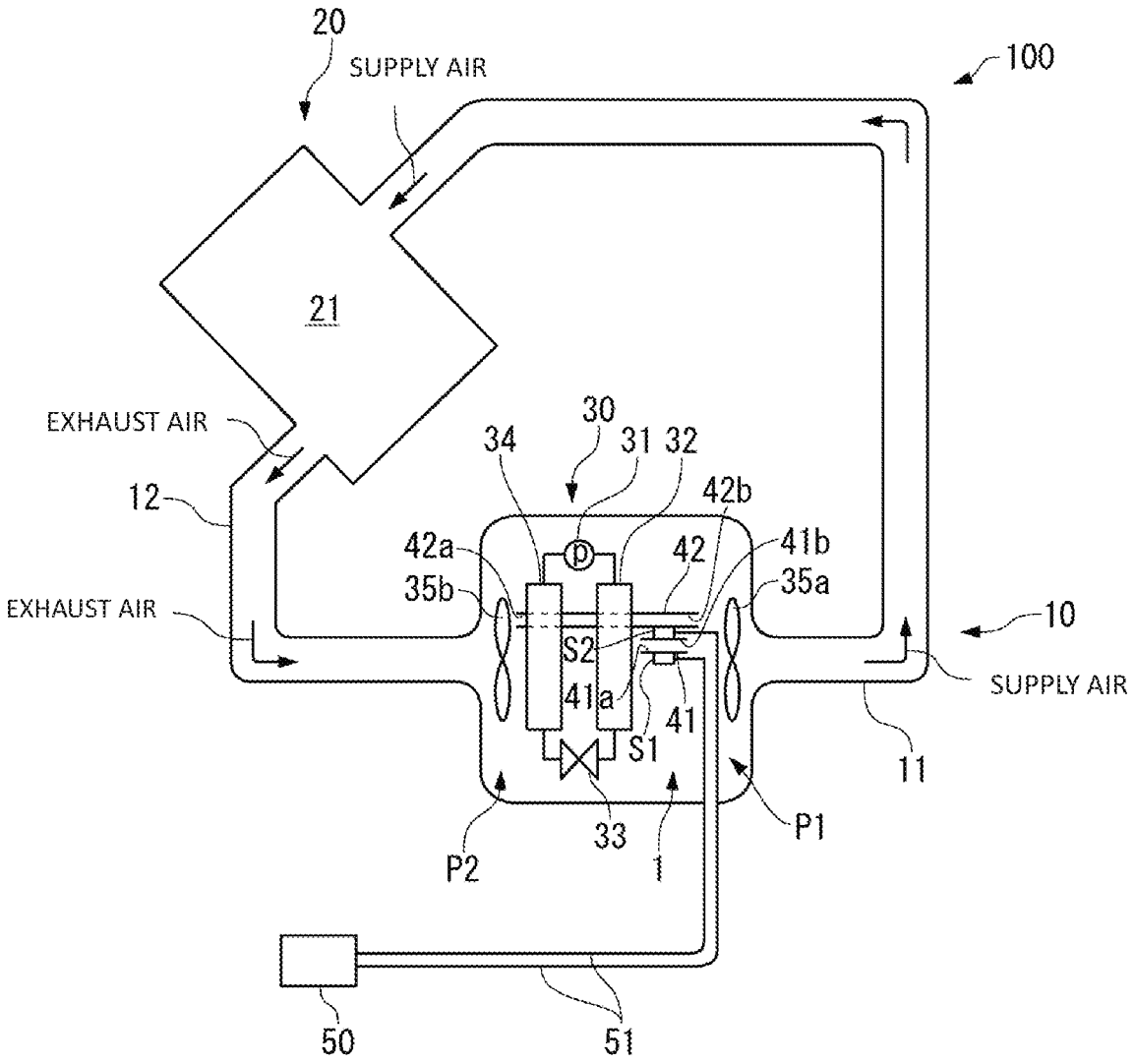
FIG. 1 is a diagram illustrating a heat pump dryer according to a first embodiment of the present invention.

FIG. 1 illustrates a schematic configuration of a heat pump dryer 100 according to a first embodiment of the present invention.

The dryer 100 includes a circulation air passage 10 that circulates air, a drying drum including a drying chamber 21 that dries a drying object and the like, and a heat pump dryer unit 30.

An absolute humidity difference sensor 1 (S1 and S2) that detects absolute humidity difference between supply air and exhaust air is provided at a position P1 on air supply side.

Heat Pump Dryer Unit 30

The heat pump dryer unit 30 includes a refrigerant circulation path that includes a compressor 31 compressing a refrigerant, a heating-side heat exchanger 32, an expansion valve 33, and a cooling-side heat exchanger 34.

In the heat pump dryer unit 30, heat circulation cycle is performed in the following manner. The high-temperature refrigerant compressed by the compressor 31 is heat-exchanged with surrounding air to heat the surrounding air in a process of passing through the heating-side heat exchanger 32. The refrigerant passed through the heating-side heat exchanger 32 passes through the expansion valve 33 and is adiabatically expanded to be decreased in temperature, and the low-temperature refrigerant then passes through the cooling-side heat exchanger 34. In this process, the refrigerant is heat-exchanged with the surrounding air to cool the surrounding air, which results in dehumidification. The refrigerant passed through the cooling-side heat exchanger 34 is again compressed by the compressor 31, and is then discharged toward the heating-side heat exchanger 32. The heating-side heat exchanger 32 corresponds to a heating source in Claim 3 of the present invention.

The heat pump dryer unit 30 includes an outlet fan 35*a* on side near the heating-side heat exchanger 32, and an inlet fan 35*b* on side near the cooling-side heat exchanger 34. The outlet fan 35*a* and the inlet fan 35*b* form flow of air circulation in which the air heated by the heating-side heat exchanger 32 is fed into the drying drum 20, the air increased in humidity inside the drying drum 20 is drawn into a discharge path 12, and the air received by the discharge path 12 is again drawn into the cooling-side heat exchanger 34.

Note that, in the above description, the example in which both of the outlet fan 35*a* and the inlet fan 35*b* are provided has been described; however, a similar air circulation can be formed only by one of the outlet fan 35*a* and the inlet fan 35*b*. Further, other air blowing means may be used as necessary.

Drying Drum 20

The drying drum 20 includes the drying chamber 21 that dries the drying object, and is connected to a supply path 11 through which heated air is supplied and the discharge path 12 to which the air that has absorbed moisture from the drying object inside the drying drum 20 is discharged.

Circulation Air Passage 10

The circulation air passage 10 includes an air passage inside the heat pump dryer unit 30, the supply path 11, the drying chamber 21 inside the drying drum 20, and the discharge path 12.

The air heated by the heating-side heat exchanger 32 is supplied as the supply air into the drying drum 20 through the supply path 11. The supply air absorbs moisture from the drying object inside the drying drum 20, is discharged as the exhaust air to the discharge path 12, and is again returned to the cooling-side heat exchanger 34 of the heat pump dryer unit 30.

Absolute Humidity Difference Sensor 1 (S1 and S2)

The absolute humidity difference sensor 1 detects difference between the humidity of the supply air to be supplied to the drying drum 20 and the humidity of the exhaust air discharged from the drying drum 20. The absolute humidity difference sensor 1 includes a first humidity detection sensor S1 that detects the humidity of the supply air, and a second humidity detection sensor S2 that detects the humidity of the exhaust air. In the absolute humidity difference sensor 1, each of the first humidity detection sensor S1 and the second humidity detection sensor S2 configures an absolute humidity sensor.

Figure 2A:
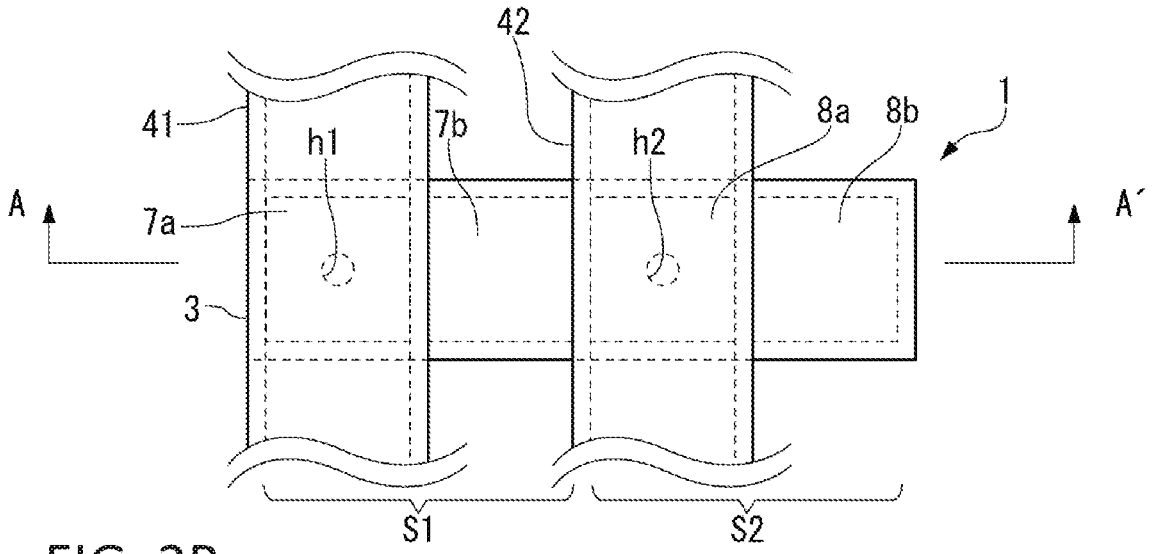
FIGS. 2A and 2B each illustrate a schematic configuration of an absolute humidity difference sensor according to the first embodiment, FIG. 2A being a plan view, and FIG. 2B being a cross-sectional view taken along a line A-A'.
Figure 2B:
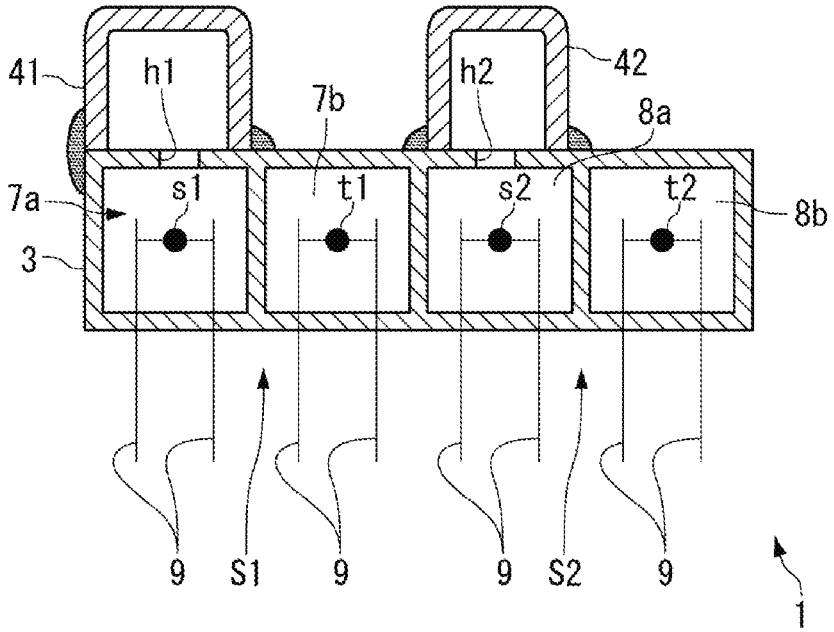

As illustrated in FIG. 2, in the absolute humidity difference sensor 1, the first humidity detection sensor S1 and the second humidity detection sensor S2 are assembled in a single case 3. The case 3 is partitioned into four spaces of a first detection chamber 7*a*, a first sealed chamber 7*b*, a second detection chamber 8*a*, and a second sealed chamber 8*b*.

A first heat-sensitive element s1 of the first humidity detection sensor S1 is housed in the first detection chamber 7*a*, and a first reference element t1 is housed in the first sealed chamber 7*b*. Lead wires 9 are respectively connected to the elements, and the lead wires 9 are each hermetically sealed.

A first ventilation window h1 is provided on the first detection chamber 7*a*, and the supply air as a detection object enters the first detection chamber 7*a* through the first ventilation window h1 as described later. Further, the first sealed chamber 7*b* is filled with dry air that has a dew point below freezing, and the first reference element t1 is placed in environment with low absolute humidity, typically, in environment with absolute humidity of zero. In other words, the first heat-sensitive element s1 is placed in environment with absolute humidity higher than that of the first reference element t1.

When a drive voltage is applied, the first heat-sensitive element s1 and the first reference element t1 are self-heated to the same temperature, for example, about 200° C. The first heat-sensitive element s1 located under the higher absolute humidity becomes lower in temperature and larger in electric resistance because of a large heat dissipation constant to air. Therefore, difference of the electric resistance occurs between the first heat-sensitive element s1 and the first reference element t1, and the absolute humidity (first humidity) of the supply air entered the first detection chamber 7*a* is detectable.

The second humidity detection sensor S2 has a similar configuration. A second heat-sensitive element s2 is housed in the second detection chamber 8*a*, and a second reference element t2 is housed in the second sealed chamber 8*b*. The lead wires 9 are respectively connected to the elements, and the lead wires 9 are each hermetically sealed.

A second ventilation window h2 is provided on the second detection chamber 8*a*, and the exhaust air as a detection object enters the second detection chamber 8*a* through the second ventilation window h2 as described later. Further, the second sealed chamber 8*b* is also filled with dry air that has a dew point below freezing.

When a drive voltage is applied to the second heat-sensitive element s2 and the second reference element t2, absolute humidity (second humidity) of the exhaust air entered the second detection chamber 8*a* is detectable based on difference of the electric resistance between the second heat-sensitive element s2 and the second reference element t2, in a manner similar to the first humidity detection sensor S1.

Note that, as for the above-described absolute humidity difference sensor 1, the example in which the single case 3 is partitioned into the four spaces has been described; however, the first humidity detection sensor S1 and the second humidity detection sensor S2 may be fabricated as two independent cases and the two cases may be then combined. Alternatively, four cases for the first detection chamber 7*a*, the first sealed chamber 7*b*, the second detection chamber 8*a*, and the second sealed chamber 8*b* may be prepared, and the four cases may be combined after assembly of the elements.

A detection circuit of the first humidity detection sensor S1 includes a bridge circuit (not illustrated) that includes the first heat-sensitive element s1 and the first reference element t1 in adjacent sides, and an unbalanced voltage thereof is outputted as a signal corresponding to the humidity difference between the environments in which the both elements are respectively placed. In this case, the absolute humidity on the first reference element t1 side is zero. Therefore, a terminal voltage of the first reference element t1 serves as a reference signal, and a signal corresponding to the humidity difference of the first detection chamber 7*a* with respect to the absolute humidity zero, namely, a signal corresponding to the absolute humidity is outputted as the unbalanced voltage outputted to the bridge circuit.

The second humidity detection sensor S2 is similarly configured. A detection circuit of the second humidity detection sensor S2 includes a bridge circuit (not illustrated) that includes the second heat-sensitive element s2 and the second reference element t2 in adjacent sides, and an unbalanced voltage thereof is outputted as a signal corresponding to the humidity difference between the environments in which both elements are placed. In this case, the absolute humidity on the second reference element t2 side is zero. Therefore, a signal corresponding to the humidity difference of the second detection chamber 8*a* with respect to the absolute humidity zero, namely, a signal corresponding to the absolute humidity is outputted as the unbalanced voltage outputted to the bridge circuit.

As illustrated in FIG. 1, the absolute humidity difference sensor 1 transmits, to a determination section 50 through signal cables 51, an electric signal that corresponds to the absolute humidity (first humidity) detected by the first humidity detection sensor S1 and an electric signal that corresponds to the absolute humidity (second humidity) detected by the second humidity detection sensor S2. The determination section 50 processes the electric signal corresponding to the first humidity and the electric signal corresponding to the second humidity to acquire a value of the absolute humidity difference corresponding to the difference between the first humidity and the second humidity, thereby determining a drying state.

Installation of Absolute Humidity Difference Sensor 1 and Guide of Detection Air As illustrated in FIG. 1 and FIG. 2, the absolute humidity difference sensor 1 is installed at the position P1 between the heating-side heat exchanger 32 and the outlet fan 35*a* of the heat pump dryer unit 30. The supply air that is generated through the heating-side heat exchanger 32 passes through the position P1.

As illustrated in FIG. 1, the absolute humidity difference sensor 1 is connected to a first conduit 41 that guides the supply air to the first humidity detection sensor S1 and a second conduit 42 that guides the exhaust air to the second humidity detection sensor S2.

The first conduit 41 includes an opening 41*a* at one end and an opening 41*b* at the other end. The one end of the first conduit 41 is disposed toward the heating-side heat exchanger 32, and the other end is disposed toward the outlet fan 35*a*. As illustrated in FIG. 2, the first conduit 41 is connected to the case 3 and communicates with the first detection chamber 7*a* through the first ventilation window h1.

The supply air as first detection air is taken into the first conduit 41 through the opening 41*a*. The taken first detection air is sucked at negative pressure of the outlet fan 35*a*, and flows toward the first humidity detection sensor S1. When the first detection air reaches the first humidity detection sensor S1, a part of the first detection air enters the first detection chamber 7*a* through the first ventilation window h1 that allows the first conduit 41 and the first detection chamber 7*a* to communicate with each other, and comes into contact with the first heat-sensitive element s1. As a result, the absolute humidity (first humidity) is detected. Thereafter, the first detection air is discharged from the opening 41*b* at the other end of the first conduit to the supply path 11 and is merged with the supply air.

The second conduit 42 includes an opening 42*a* at one end and an opening 42*b* at the other end. The one end of the second conduit 42 is disposed toward the inlet fan 35*b*, and the other end is disposed toward the outlet fan 35*a*. As illustrated in FIG. 2, the second conduit 42 is connected to the case 3 and communicates with the second detection chamber 8*a* through the second ventilation window h2.

The exhaust air as second detection air is taken into the second conduit 42 through the opening 42*a*. The taken second detection air is sucked at the negative pressure of the outlet fan 35*a*, and flows toward the second humidity detection sensor S2. When the second detection air reaches the second humidity detection sensor S2, a part of the second detection air enters the second detection chamber 8*a* through the second ventilation window h2 that allows the second conduit 42 and the second detection chamber 8*a* to communicate with each other, and comes into contact with the second heat-sensitive element s2. As a result, the absolute humidity (second humidity) is detected. Thereafter, the second detection air is discharged from the opening 42*b* at the other end of the second conduit 42 to the supply path 11 and is merged with the supply air.

Note that the second conduit 42 is preferably laid inside the heat pump dryer unit 30 so as to avoid interference with the cooling-side heat exchanger 34 and the heating-side heat exchanger 32.

Operation of Dryer 100

The operation of the dryer 100 is described below.

To dry the drying object by the dryer 100, the air warmed by the heating-side heat exchanger 32 is fed to the supply path 11 by the outlet fan 35*a*, and is fed into the drying drum 20 through the supply path 11. The fed air for drying comes into contact with the drying object in the drying chamber 21 of the drying drum 20 to absorb moisture, and is then discharged from the drying chamber 21 toward the discharge path 12. The exhaust air is cooled in a process of being sucked into the inlet fan 35*b* and passing through the cooling-side heat exchanger 34. Therefore, the moisture contained in the exhaust air is dehumidified by dew condensation. The dehumidified air passes through the heating-side heat exchanger 32, and is accordingly fed to the supply path 11 as the heated air, namely, the supply air.

The dryer 100 repeats the above-described cycle, thereby absorbing moisture from the drying object to promote drying. In this cycle, the humidity difference between the supply air supplied to the drying chamber 21 and the exhaust air returned to the discharge path 12 is large when the moisture amount of the drying object is large. The humidity difference becomes smaller as the drying proceeds. The dryer 100 continuously detects the humidity difference to determine the degree of the drying. The procedure is described below.

Operation of Absolute Humidity Difference Sensor 1

The dryer 100 includes the absolute humidity difference sensor 1 to detect the absolute humidity of the air in the supply path 11 and the discharge path 12. Detection information is transmitted to the determination section 50 provided in the dryer 100. The determination section 50 determines the drying state based on the detection information to decide stop or continuation of the operation of the dryer 100.

Next, a procedure performed by the absolute humidity difference sensor 1 to determine the degree of the drying while monitoring the drying process is described based on an example in which measurement is performed with use of the dryer 100 including the heat pump dryer unit 30.

Measurement Example

The measurement was performed with use of a washer/dryer including the heat pump dryer unit 30. A predetermined amount of washed laundry was dewatered, and the dewatered laundry serving as the drying object was put in the drying chamber 21 of the drying drum 20 and was dried. A waveform of an output of the absolute humidity difference sensor 1 was observed in the drying.

Figure 4A:
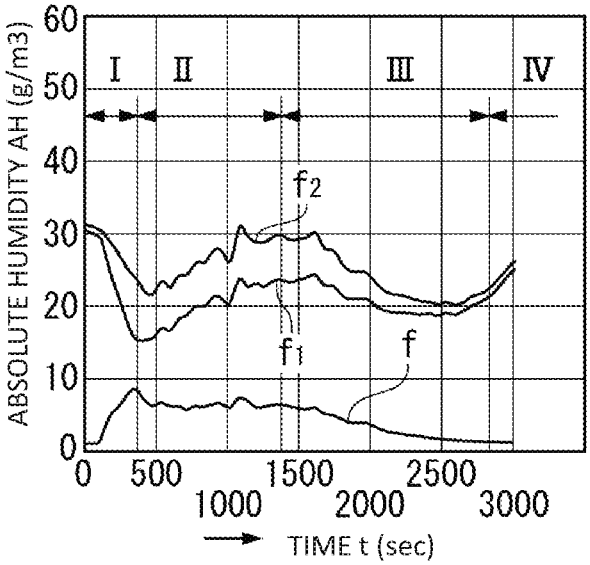
FIGS. 4A to 4C are graphs each illustrating an example of monitoring of humidity that is detected by the absolute humidity difference sensor according to the first embodiment.

FIG. 4A illustrates a result thereof.

Note that, in FIG. 4A, a reference numeral f1 denotes the absolute humidity (first humidity) of the supply air detected by the first humidity detection sensor S1, a reference numeral f2 denotes the absolute humidity (second humidity) of the exhaust air detected by the second humidity detection sensor S2, and a reference numeral f denotes difference therebetween.

As illustrated in FIG. 4A, the absolute humidity f1 and the absolute humidity f2 both make a transition to a region I where both of the absolute humidity f1 and the absolute humidity f2 relatively rapidly drop immediately after start of the drying, then a region II where both of the absolute humidity f1 and the absolute humidity f2 gently rise, a region III where both of the absolute humidity f1 and the absolute humidity f2 gently drop after reaching respective peaks, and finally a region IV where difference between the absolute humidity f1 and the absolute humidity f2 is maintained at substantially constant.

As illustrated in FIG. 4A, correlativity of the absolute humidity f1 and the absolute humidity f2 is observed in dropping behavior and in rising behavior. The tendency is remarkable in the region II and the region III.

On the other hand, the absolute humidity difference f rapidly rises in the region I and then shifts at a substantially fixed value in the region II. The absolute humidity difference f shows a tendency to monotonically drop in the region III, and then shifts at a constant low value in the region IV. The above-described tendency becomes clearer by referring to FIG. 4B with enlarged Y-axis. Relationship between the behavior of the absolute humidity difference f and the drying state is described below with reference to FIG. 4B.

Drying State in Regions I, II, III, and IV

It is inferred that, in the region I shortly after start of the drying, the moisture contained in the drying object is rapidly absorbed by the supply air and the drying rapidly progresses, and therefore, the humidity difference between the supply air and the exhaust air is increased.

In the region II after a certain time has elapsed from the start of the drying, the moisture still sufficiently remains in the drying object. Therefore, the absolute humidity difference between the position P2 and the position P1 is large.

In the region III after a certain time has further elapsed from the start of the drying, the moisture amount in the drying object is small. Therefore, the absolute humidity of the supply air and the absolute humidity of the exhaust air both become small. It is inferred that the humidity difference between the supply air and the exhaust air becomes accordingly small.

In the region IV after a certain time has further elapsed from the start of the drying, the amount of moisture contained in the drying object is extremely small. Therefore, it is inferred that the absolute humidity of the exhaust air becomes equivalent to that of the supply air, and the humidity difference between the supply air and the exhaust air accordingly becomes minute. In other words, it is possible to determine a state where the operation of the dryer 100 should be terminated, by detecting that the humidity difference has become minute.

Method of Determining Drying State 1

As described above, when the drying of the drying object progresses, the difference between the humidity f2 of the exhaust air at the position P2 and the absolute humidity f1 of the supply air at the position P1 becomes small.

Therefore, the determination section 50 stores the following expression (1) and a determination value f0 to be compared with a calculation result of the following expression (1), and compares the calculation result of the expression (1) with the determination value f0 based on an expression (2), thereby determining the drying state.

$$f=f2-f1(g/m^3) \quad (1)$$

where f1 is a value of the absolute humidity detected by the humidity sensor S1, and f2 is a value of the absolute humidity detected by the humidity sensor S2.

$$f \leq f0 \quad (2)$$

When the expression (2) is satisfied, the determination section 50 determines that the drying has been completed, and instructs operation stop of the dryer 100. On the other hand, when the expression (2) is not satisfied, the determination section 50 determines that the drying is still insufficient, and instructs operation continuation of the dryer 100. Therefore, the dryer 100 does not excessively dry the drying object, and does not stop the operation though the drying is insufficient.

Method of Determining Drying Completion 2

Figure 4B:
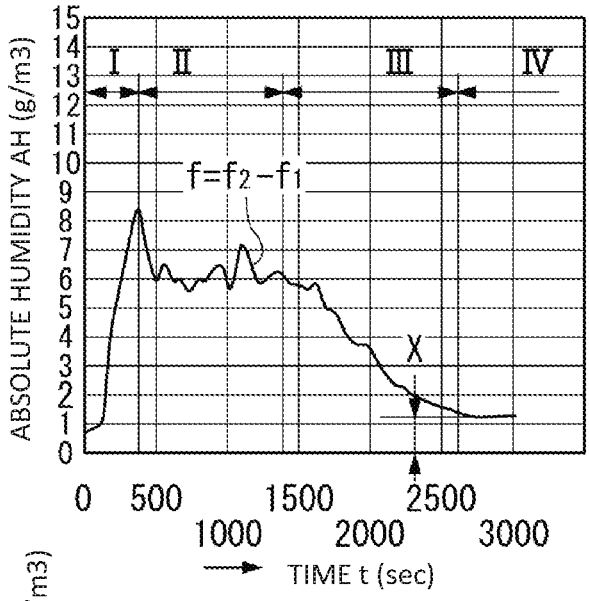
Figure 4C:
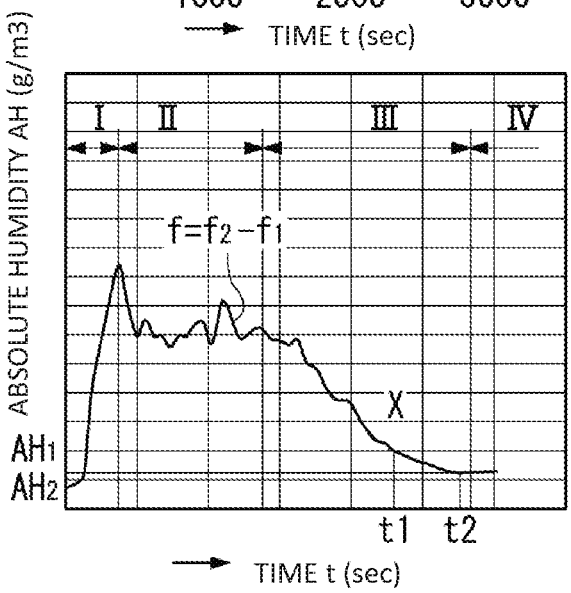

Further, as illustrated in FIGS. 4B and 4C, a time change rate C of the absolute humidity difference f is varied in the process of drying the drying object. Accordingly, comparing the time change rate C and a predetermined determination value C0 makes it possible to decide operation stop or operation continuation of the dryer 100.

Modification of First Embodiment

Figure 3:
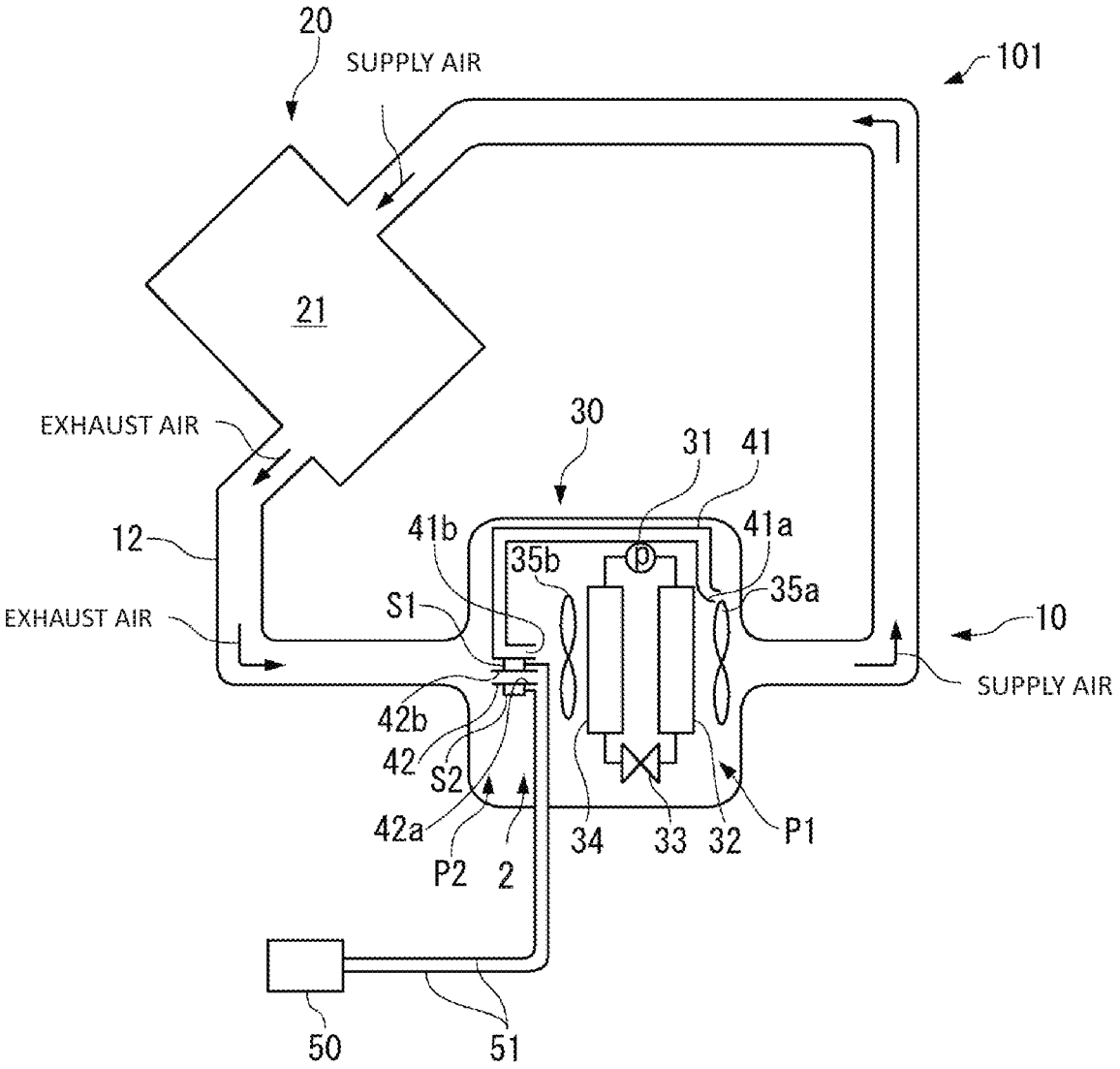
FIG. 3 is a diagram illustrating a heat pump dryer according to a modification of the first embodiment.

FIG. 3 illustrates a schematic configuration of a heat pump dryer 101 according to a modification of the first embodiment. The modification is different from the dryer 100 in that the absolute humidity difference sensor 1 (S1 and S2) is provided upstream of the cooling-side heat exchanger 34 and the inlet fan 35*b* of the heat pump dryer unit 30. In this case, as illustrated in FIG. 3, the first conduit 41 is laid around the heating-side heat exchanger 32 and the cooling-side heat exchanger 34, and sucks the supply air from the downstream of the heating-side heat exchanger 32 and guides the supply air to the first humidity detection sensor S1. Further, the second conduit 42 sucks the exhaust air from the upstream of the inlet fan 35*b*, and guides the exhaust air to the second humidity detection sensor S2. In any case, the first conduit 41 takes in the supply air that has passed through the heating-side heat exchanger 32, and the second conduit 42 takes in the exhaust air before passing through the cooling-side heat exchanger 34.

The absolute humidity difference sensor 1 (S1 and S2) can accurately detect the humidity difference between the supply air and the exhaust air in a manner similar to the first embodiment even when installed as described above.

Note that, in FIG. 3, components similar to those of the dryer 100 in FIG. 1 are denoted by the reference numerals same as those in FIG. 1.

Action and Effects of First Embodiment

According to the dryer 100 (101), the humidity of the supply air and the humidity of the exhaust air are directly detected. Therefore, it is possible to accurately determine the degree of drying as compared with a case where the humidity value is collated with the detected temperature.

In the dryer 100, the absolute humidity difference between the supply air and the exhaust air is detectable by the first humidity detection sensor S1 and the second humidity detection sensor S2 that are collectively provided at one place. Therefore, the sensor is easily mounted and less mounting space is required. Further, since the dryer 100 includes the determination section 50 that determines the drying state, overdrying and insufficient drying do not occur.

Moreover, according to the dryer 100, the surrounding temperature of the first humidity detection sensor and the surrounding temperature of the second humidity detection sensor can be regarded as equal to each other. Therefore, in the case where the two humidity detection sensors each detect the relative humidity, the detected relative humidity can be converted into the absolute humidity only by one temperature sensor.

Second Embodiment

Next, an absolute humidity difference sensor 2 according to a second embodiment of the present invention is described with reference to FIG. 5 and FIG. 6.

In the absolute humidity difference sensor 1 according to the first embodiment, the four heat-sensitive elements are necessary in total because each of the first humidity detection sensor S1 and the second humidity detection sensor S2 includes the heat-sensitive element and the reference element. In contrast, in the absolute humidity difference sensor 2 according to the second embodiment, the first humidity detection sensor S1 and the second humidity detection sensor S2 include only two heat-sensitive elements in total. The absolute humidity difference sensor 2 includes two elements of the first humidity detection sensor S1 and the second humidity detection sensor S2.

Configuration of Absolute Humidity Difference Sensor 2

Figure 5A:
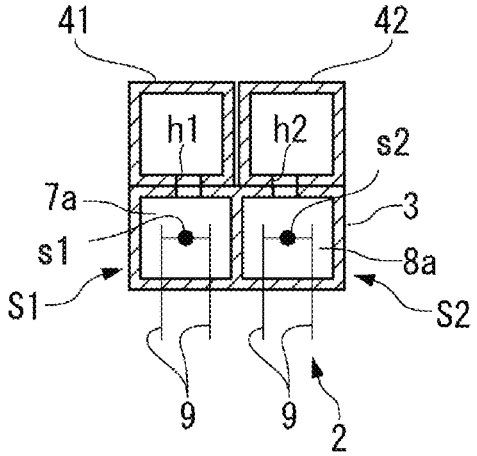
FIGS. 5A to 5C each illustrate a schematic configuration of an absolute humidity difference sensor according to a second embodiment of the present invention, FIG. 5A being a cross-sectional view, FIG. 5B illustrating a bridge circuit, and FIG. 5C being a graph illustrating an example of a detection result of humidity difference.

As illustrated in FIG. 5A, in the absolute humidity difference sensor 2, the first humidity detection sensor S1 and the second humidity detection sensor S2 are assembled in the single case 3. The case 3 is partitioned into two spaces of the first detection chamber 7*a* and the second detection chamber 8*a*.

The first humidity detection sensor S1 includes the first detection chamber 7*a*, the first heat-sensitive element s1, and the first ventilation window h1. The second humidity detection sensor S2 includes the second detection chamber 8*a*, the second heat-sensitive element s2, and the second ventilation window h2.

The first detection chamber 7*a* and the second detection chamber 8*a* are adjacently provided in the case 3. The first conduit 41 is attached to the first detection chamber 7*a*, and the second conduit 42 is attached to the second detection chamber 8*a*.

The first heat-sensitive element s1 is connected to the hermetically-sealed lead wires 9, and is housed in the first detection chamber 7*a*. Likewise, the second heat-sensitive element s2 is connected to the hermetically-sealed lead wires 9, and is housed in the second detection chamber 8*a*.

The first conduit 41 is connected to the case 3, and communicates with the first detection chamber 7*a* through the first ventilation window h1. The first detection air guided by the first conduit 41 partially enters the first detection chamber 7*a* through the first ventilation window h1, and comes into contact with the first heat-sensitive element s1.

Likewise, the second conduit 42 is connected to the case 3, and communicates with the second detection chamber 8*a* through the second ventilation window h2. The second detection air guided by the second conduit 42 partially enters the second detection chamber 8*a* through the second ventilation window h2, and comes into contact with the second heat-sensitive element s2.

Moreover, since the first humidity detection sensor S1 and the second humidity detection sensor S2 are adjacently provided, the first humidity detection sensor S1 and the second humidity detection sensor S2 can be regarded as being placed in the same temperature environment.

Figure 5B:
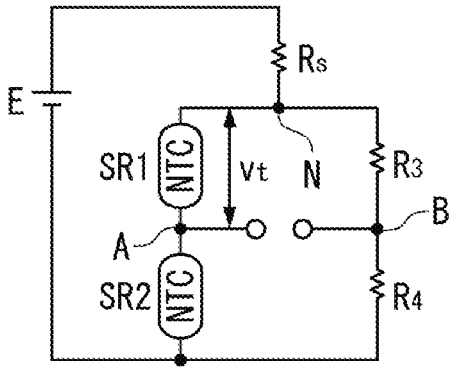
Figure 5C:
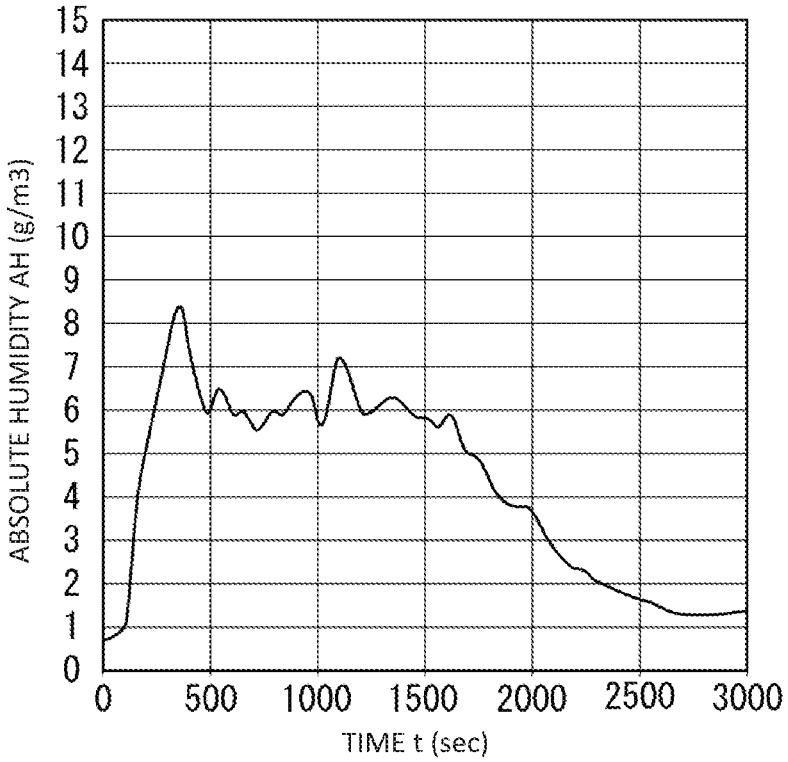

FIG. 5B illustrates a bridge circuit for signal processing of the absolute humidity difference sensor 2 including the above-described configuration. The bridge circuit includes, as circuit elements, a direct-current power supply E, a resistor SR1 of the first heat-sensitive element s1, a resistor SR2 of the second heat-sensitive element s2, resistors R3 and R4 configuring an opposite side of the bridge, and a series resistor Rs adjusting a circuit current. Note that the first heat-sensitive element s1 and the second heat-sensitive element s2 are both electrically connected to the bridge circuit through the lead wires 9, and are self-heated to about 200° C. by power supplied from the direct-current power supply E. In the bridge circuit, the resistors R3 and R4 are previously adjusted such that a potential difference between connection midpoints A and B becomes zero when the absolute humidity of the first heat-sensitive element s1 and the absolute humidity of the second heat-sensitive element s2 are equal to each other, for example, when both absolute humidity is zero.

Operation of Absolute Humidity Difference Sensor 2

When air with different humidity is guided to the first detection chamber 7*a* and the second detection chamber 8*a* and come into contact with the first heat-sensitive element s1 and the second heat-sensitive element s2, respectively, in the absolute humidity difference sensor 2 including the above-described configuration, values of the respective resistors SR1 and SR2 of the bridge circuit are varied according to an amount of moisture contained in the air. The variation is detected as an unbalanced voltage between the connection midpoints A and B, and the unbalanced voltage becomes large as the humidity difference is large. This allows for detection of the absolute humidity difference.

Installation of Absolute Humidity Difference Sensor 2

An example in which the above-described absolute humidity difference sensor 2 is installed at the position P2 of the dryer 100 in place of the absolute humidity difference sensor 1 described in the first embodiment, and drying process is monitored is described.

Note that, in this example, the drying process is performed with use of the heat pump dryer unit 30 same as that in the monitoring by the absolute humidity difference sensor 1 and with use of the same amount of the drying object. In other words, the drying process is performed by a procedure similar to the series of procedure described in FIG. 4 except for change from the absolute humidity difference sensor 1 to the absolute humidity difference sensor 2.

FIG. 4C illustrates a graph example of the absolute humidity difference f when the difference of the absolute humidity between the position P1 and the position P2 is detected by the absolute humidity difference sensor 2.

The absolute humidity difference f shows a variation tendency similar to that in the case of FIG. 4B, and includes feature regions I to IV according to progress of the drying. In other words, it is deemed that the absolute humidity difference sensor 2 performs a function similar to that of the absolute humidity difference sensor 1 according to the first embodiment.

Output of Temperature Detection Signal

Figure 6:
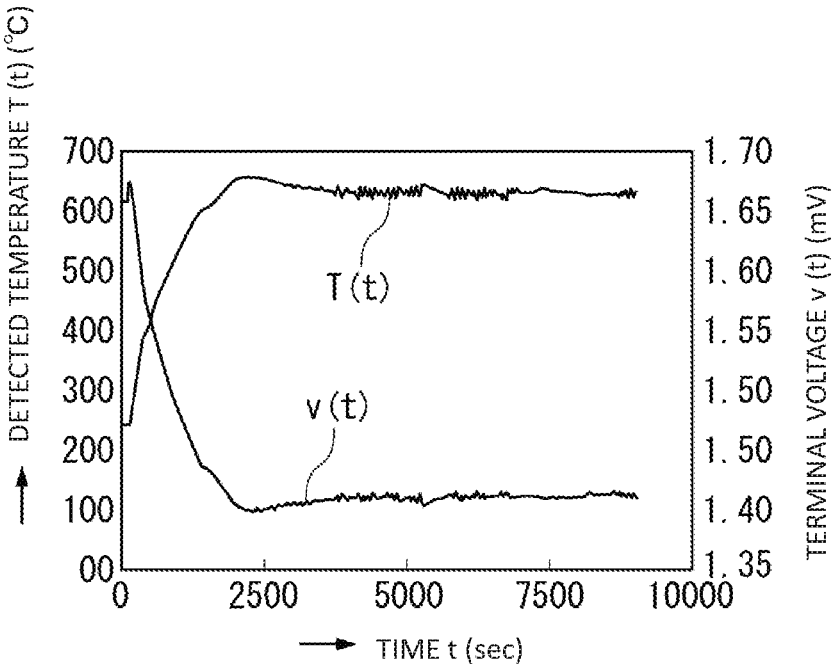
FIG. 6 is a graph illustrating an example of monitoring of a potential difference between both ends of a heat-sensitive element in the absolute humidity difference sensor according to the second embodiment.

FIG. 6 illustrates a result when a potential difference v between the connection midpoint A and a terminal N of the bridge circuit, namely, between both ends of the first heat-sensitive element s1 and temperature T detected by a temperature sensor (not illustrated) provided adjacently to the absolute humidity difference sensor 2 are monitored at the same time. As can be seen from comparison of the potential difference v and the temperature T, inverse correlation relationship is established between the temperature T detected by the temperature sensor and the potential difference v, which makes it possible to specify the temperature T from the value of the potential difference v.

As described above, according to the absolute humidity difference sensor 2 of the second embodiment, it is possible to obtain the output signals corresponding to the absolute humidity difference between the terminal and both of the connection midpoint A and the connection midpoint B of the bridge circuit, and to obtain the output signal corresponding to the temperature between the terminals of the resistor SR1 of the first heat-sensitive element s1. Accordingly, the absolute humidity difference sensor 2 of the second embodiment makes it possible to detect both of the humidity difference and the temperature at the same time. The signal corresponding to the temperature is usable as control information to monitor overheating of the dryer 100 or to control the dryer 100.

Note that, it is confirmed that the output signal corresponding to the temperature similarly appears between the terminals of the resistor SR2 of the second heat-sensitive element s2. Therefore, any of the output signals may be used as the temperature signal.

Action and Effects of Second Embodiment

The absolute humidity difference sensor 2 includes the first conduit 41 and the second conduit 42 that can guide the detection air from different two positions. Therefore, for example, installing the humidity detection sensors at one place other than the above-described two positions makes it possible to detect the absolute humidity difference between the two positions.

Since it is sufficient for the absolute humidity difference sensor 2 to include the two heat-sensitive elements, it is possible to suppress its cost as compared with the absolute humidity difference sensor 1. In addition, the first detection chamber 7*a* and the second detection chamber 8*a* are enough as the spaces housing the respective heat-sensitive elements. This makes it possible to downsize the absolute humidity difference sensor 2.

Moreover, in the absolute humidity difference sensor 2, the potential difference corresponding to the environment temperature appears between the terminals of each of the resistor SR1 of the first heat-sensitive element s1 and the resistor SR2 of the second heat-sensitive element s2. Therefore, it is possible to use the absolute humidity difference sensor 2 as the sensor also performing temperature detection.

Other than the above, the configurations described in the above-described embodiments may be selected or appropriately modified without departing from the scope of the present invention.

Figure 7:
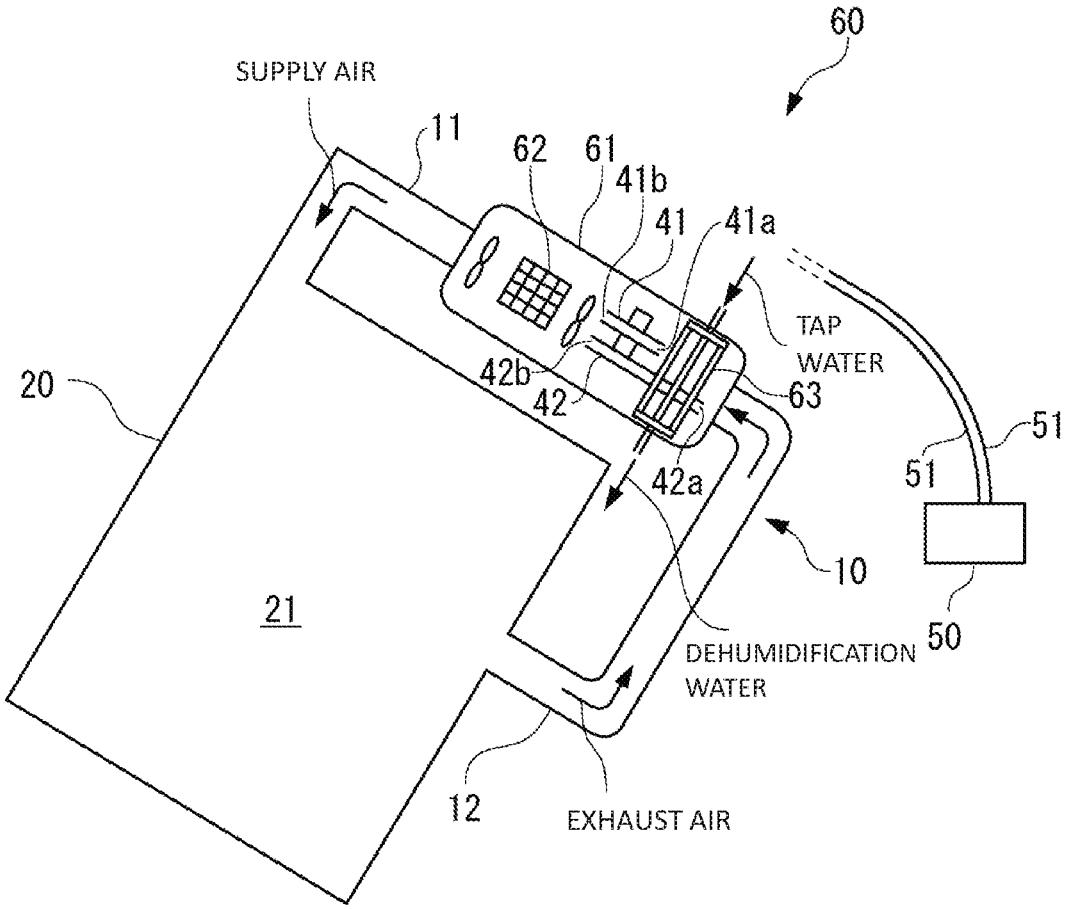
FIG. 7 is a diagram illustrating a heater dryer according to the first embodiment.

For example, as illustrated in FIG. 7, the present invention is applicable to a heater dryer 60.

The dryer 60 includes, in a heater dryer unit 61, a cooler 63 that dehumidifies the exhaust air with use of tap water, and the exhaust air cooled by the cooler 63 is heated by a hot plate 62 to generate supply air. The absolute humidity difference sensor 1 or the absolute humidity difference sensor 2 includes the first conduit 41 that takes in the exhaust air before passing through the cooler 63, and the first conduit 42 that takes in the exhaust air after passing through the cooler 63.

Note that, in FIG. 7, components similar to those of the dryer 100 in FIG. 1 are denoted by the reference numerals same as those in FIG. 1.

Further, in the above description, the example in which the air drying the drying object is circulated as an assumption has been described; however, the dryer according to the present invention is applicable to a dryer in which the air drying the drying object is not circulated.

REFERENCE SIGNS LIST

100, 101 Dryer
10 Circulation air passage
11 Supply path
12 Discharge path
13 Discharge port
20 Drying drum
21 Drying chamber
30 Heat pump dryer unit
31 Compressor
32 Heating-side heat exchanger
33 Expansion valve
34 Cooling-side heat exchanger
35*a* Outlet fan
35*b* Inlet fan
41 First conduit
41*a*, 41*b* Opening
42 Second conduit
42*a*, 42*b* Opening
50 Determination section
51 Signal cable
60 Dryer
61 Heater dryer unit
62 Hot plate
P1 Position in supply path
P2 Position in discharge path
S1, S2 First humidity detection sensor, second humidity detection sensor
1, 2 Absolute humidity difference sensor
3 Case
h1, h2 First ventilation window, second ventilation window
s1, s2 First heat-sensitive element, second heat-sensitive element
t1, t2 First reference element, second reference element
7*a*, 8*a* First detection chamber, second detection chamber
7*b*, 8*b* First sealed chamber, second sealed chamber
9 Lead wire

What is claimed is:

1. A dryer, comprising:

a drying drum configured to house a drying object;

a supply path configured to feed supply air that is heated air, to an inside of the drying drum;

a discharge path configured to take in exhaust air that is air discharged from the inside of the drying drum; and a humidity difference sensor that includes a first humidity detection sensor configured to detect first humidity as humidity of the supply air, and a second humidity detection sensor configured to detect second humidity as humidity of the exhaust air, wherein the first humidity detection sensor includes a first detection chamber, a first heat-sensitive element housed in the first detection chamber, and a first ventilation window through which part of the supply air is supplied to the first detection chamber, and the second humidity detection sensor includes a second detection chamber, a second heat- sensitive element housed in the second detection chamber, and a second ventilation window through which part of the exhaust air is supplied to the second detection chamber, wherein the first ventilation window is open in a direction transverse to a direction in which the supply air flows, and the second ventilation window is open in a direction transverse to a direction in which the exhaust air flows.

2. The dryer according to claim 1, further comprising a first conduit through which the supply air is guided to the first ventilation window and a second conduit through which the exhaust air is guided to the second ventilation window.

3. The dryer according to claim 2, further comprising:

a heating source configured to heat the exhaust air supplied from the discharge path, to generate the supply air; and a heat pump dryer unit configured to feed the generated supply air to the supply path, wherein the humidity difference sensor is disposed in a region where the supply air passes, inside the heat pump dryer unit, the first humidity detection sensor detects the first humidity when the supply air is supplied to the first detection chamber through the first ventilation window, and the second humidity detection sensor detects the second humidity when the exhaust gas obtained upstream of the heating source is guided through the second conduit and is supplied to the second detection chamber through the second ventilation window.

4. The dryer according to claim 2, further comprising:

a heating source configured to heat the exhaust air supplied from the discharge path, to generate the supply air; and a heat pump dryer unit configured to feed the generated supply air to the supply path, wherein the humidity difference sensor is disposed in a region where the exhaust air passes, inside the heat pump dryer unit, the first humidity detection sensor detects the first humidity when the supply air obtained downstream of the heating source is guided through the first conduit and is supplied to the first detection chamber through the first ventilation window, and the second humidity detection sensor detects the second humidity when the exhaust air is supplied to the second detection chamber through the second ventilation window.

5. The dryer according to claim 1, wherein the first humidity detection sensor and the second humidity detection sensor configure an absolute humidity difference sensor that detects absolute humidity difference.

6. The dryer according to claim 1, wherein a heating system of the supply air is one of a heat pump system and a heater system.

7. The dryer according to claim 1, wherein the humidity difference sensor further includes a reference element configured to generate a reference signal of absolute humidity.

8. The dryer according to claim 7, wherein the humidity difference sensor further includes a sealed chamber configured to house the reference element.

9. The dryer according to claim 8, wherein the sealed chamber is provided adjacently to one or both of the first detection chamber and the second detection chamber.

10. The dryer according to claim 1, wherein, the first humidity detection sensor includes a first reference element configured to generate a reference signal of absolute humidity, the second humidity detection sensor includes a second reference element configured to generate a reference signal of absolute humidity, the first reference element is provided in a first sealed chamber adjacent to the first detection chamber, and the second reference element is provided in a second sealed chamber adjacent to the second detection chamber.

11. An absolute humidity difference sensor that detects absolute humidity difference between first detection air flowing in a first predetermined direction and second detection air flowing in a second predetermined direction, the absolute humidity difference sensor comprising:

a first humidity detection sensor that includes a first detection chamber, a first heat-sensitive element housed in the first detection chamber, and a first ventilation window through which part of the first detection air is supplied to the first detection chamber; and a second humidity detection sensor that includes a second detection chamber, a second heat-sensitive element housed in the second detection chamber, and a second ventilation window through which part of the second detection air is supplied to the second detection chamber, wherein:

the first ventilation window is open in a direction transverse to the first predetermined direction; and the second ventilation window is open in a direction transverse to the second predetermined direction.

12. The absolute humidity difference sensor according to claim 11, further comprising a bridge circuit that includes the first heat-sensitive element and the second heat-sensitive element in adjacent sides, wherein absolute humidity difference between the first detection air and the second detection air is detected based on an unbalanced voltage of the bridge circuit when the first detection air is brought into contact with the first heat-sensitive element and the second detection air is brought into contact with the second heat-sensitive element.

13. The absolute humidity difference sensor according to claim 11, wherein the absolute humidity difference sensor further includes a reference element configured to generate a reference signal of absolute humidity.

14. The absolute humidity difference sensor according to claim 13, wherein the absolute humidity difference sensor further includes a sealed chamber configured to house the reference element.

15. The absolute humidity difference sensor according to claim 14, wherein the sealed chamber is provided adjacently to one or both of the first detection chamber and the second detection chamber.

16. The absolute humidity difference sensor according to claim 11, wherein, the first humidity detection sensor includes a first reference element configured to generate a reference signal of absolute humidity, the second humidity detection sensor includes a second reference element configured to generate a reference signal of absolute humidity, the first reference element is provided in a first sealed chamber adjacent to the first detection chamber, and the second reference element is provided in a second sealed chamber adjacent to the second detection chamber.

17. The absolute humidity difference sensor according to claim 11, further comprising one or both of a first conduit through which the first detection air is guided to the first ventilation window and a second conduit through which the second detection air is guided to the second ventilation window.

18. The absolute humidity difference sensor according to claim 11, further comprising a single case in which the first humidity detection sensor and the second humidity detection sensor are assembled.

19. The absolute humidity difference sensor according to claim 11, wherein the absolute humidity difference sensor further comprises a determination section configured to determine a degree of drying based on comparison between the absolute humidity difference and a predetermined value.

20. The absolute humidity difference sensor according to claim 11, wherein the absolute humidity difference sensor further comprises a determination section configured to determine a degree of drying based on comparison between a time change rate of the absolute humidity difference and a predetermined value.

* * * * *